US008230854B2

(12) United States Patent
Kruger et al.

(10) Patent No.: US 8,230,854 B2
(45) Date of Patent: Jul. 31, 2012

(54) OXYGEN-GENERATING BREATHING APPARATUS

(75) Inventors: Frank Kruger, Berlin (DE); Karl-Heinz Feldner, Berlin (DE); Karl-Heinz Köhricht, Berlin (DE)

(73) Assignee: MSA Auer GmbH, Berlin (DE)

( * ) Notice: Subject to any disclaimer, the term of this patent is extended or adjusted under 35 U.S.C. 154(b) by 1136 days.

(21) Appl. No.: 11/795,701

(22) PCT Filed: Jan. 19, 2006

(86) PCT No.: PCT/DE2006/000072

§ 371 (c)(1), (2), (4) Date: Apr. 21, 2008

(87) PCT Pub. No.: WO2006/076895

PCT Pub. Date: Jul. 27, 2006

(65) Prior Publication Data

US 2008/0276934 A1 Nov. 13, 2008

(30) Foreign Application Priority Data

Jan. 19, 2006 (DE) ..... 10 2005 003 176

(51) Int. Cl.

| | |
|---|---|
| ***A61M 15/00*** | (2006.01) |
| ***A61M 16/00*** | (2006.01) |
| ***A62B 7/08*** | (2006.01) |
| ***A62B 21/00*** | (2006.01) |

(52) U.S. Cl. ..... 128/202.26; 128/205.27; 128/205.28

(58) Field of Classification Search ..... 128/202.26, 128/204.17, 204.15, 205.29, 205.27, 205.28, 128/200.24, 202.25, 205.12, 205.22, 206.16, 128/206.17, 201.25

See application file for complete search history.

(56) References Cited

U.S. PATENT DOCUMENTS

| | | | |
|---|---|---|---|
| 2,517,209 | A | 8/1950 | Jackson et al. |
| 4,019,509 | A | 4/1977 | Li et al. |
| 4,020,833 | A | 5/1977 | Rind |

(Continued)

FOREIGN PATENT DOCUMENTS

| | | | |
|---|---|---|---|
| CN | 85103668 | A | 11/1986 |

(Continued)

OTHER PUBLICATIONS

English translation of the International Preliminary Report on Patentability in corresponding Int'l Appln. PCT/DE 2006/000072.

*Primary Examiner* — Justine Yu
*Assistant Examiner* — Colin W Stuart
(74) *Attorney, Agent, or Firm* — The Webb Law Firm

(57) ABSTRACT

The chemical cartridge of a breathing apparatus, through which respiratory air flows to generate oxygen is divided into a plurality of air treatment chambers by retaining grids. An impact-damping member including a multilayer fine wire mesh, which abuts flat against the relevant cover is located in the external air treatment chambers while provided in the middle air treatment chambers is a damping element including a multilayer fine-wire mesh folded in a zigzag fashion, having folded edges running parallel and at a distance from the outer wall of the chemical cartridge, one edge thereof running in a zigzag fashion is fixed to a wire grid. The damping elements of the adjacent air treatment chambers are not in alignment. Potassium hyperoxide granules for oxygen generation are located in the air treatment chambers. One air treatment chamber can be filled with lithium hydroxide tablets for binding excess carbon dioxide.

11 Claims, 1 Drawing Sheet

U.S. PATENT DOCUMENTS

Figure 1:
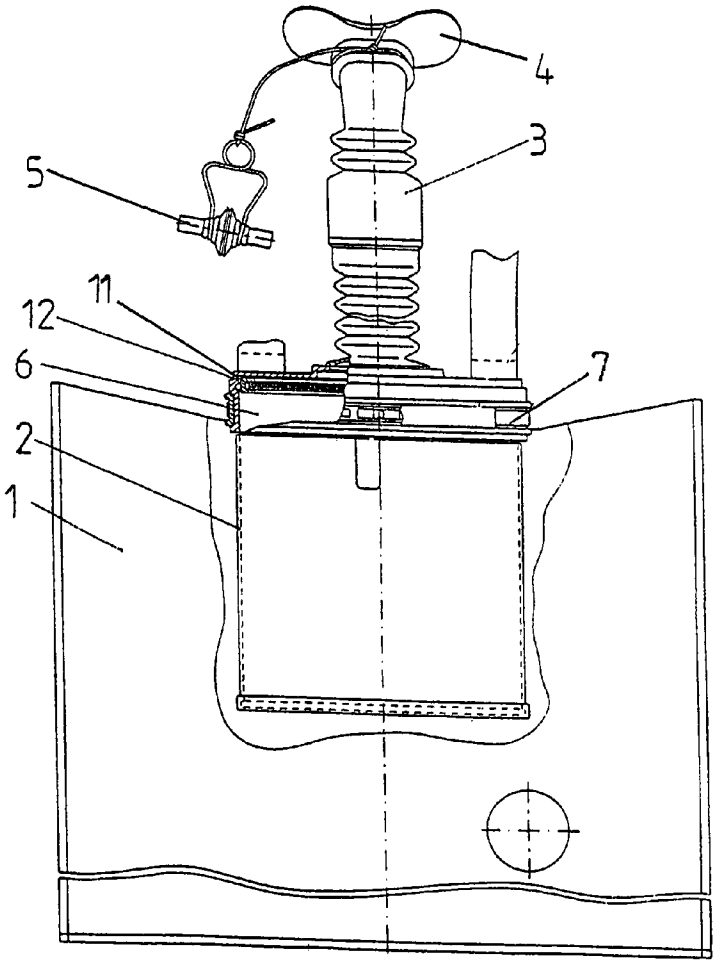

| | | | | |
|---|---|---|---|---|
| 4,212,846 | A * | 7/1980 | Wise | 422/122 |
| 4,491,130 | A * | 1/1985 | Pasternack | 128/202.26 |
| 4,515,156 | A | 5/1985 | Khudosovtsev et al. | |
| 5,038,768 | A * | 8/1991 | McGoff et al. | 128/202.26 |
| 5,222,479 | A * | 6/1993 | Brauer et al. | 128/202.26 |
| 5,394,867 | A * | 3/1995 | Swann | 128/201.25 |
| 5,690,099 | A * | 11/1997 | Abramov et al. | 128/202.26 |
| 6,340,024 | B1 * | 1/2002 | Brookman et al. | 128/201.25 |
| 2004/0219076 | A1 * | 11/2004 | Zettel et al. | 422/177 |

FOREIGN PATENT DOCUMENTS

| | | | |
|---|---|---|---|
| DE | 509032 | | 10/1930 |
| DE | 3324222 | C2 | 7/1984 |
| DE | 3426757 | A1 | 1/1986 |
| GB | 2258813 | A * | 2/1993 |

* cited by examiner

OXYGEN-GENERATING BREATHING APPARATUS

The invention relates to an oxygen-generating breathing apparatus comprising a chemical cartridge through which flow takes place in both directions, which is connected to a breathing hose and a breathing bag, wherein the chemical cartridge comprises a plurality of air treatment chambers separated from one another by air-permeable retaining grids and an air treatment chamber adjacent to the breathing bag is filled with a carbon-dioxide-binding chemical whereas the chemical for oxygen generation, present in granular form, is located in the other air treatment chambers.

An oxygen-generating breathing apparatus of this type is previously known from U.S. Pat. No. 4,515,156 A. This is intended to achieve improved distribution and thorough mixing of the respiratory gas by dividing the chemical cartridge into air treatment chambers. Multi-cell space screens are provided for better heat distribution and removal and helical springs and perforated transverse walls are provided for damping impact loads.

In breathing apparatus of this type, the exhaled air of the user is passed over a chemical located in a canister or a chemical cartridge, for example, potassium hyperoxide ($KO_2$) present in granular form. As a result of the carbon dioxide present in the exhaled air which reacts with the chemical, oxygen is generated in an exothermic reaction and is passed from the chemical cartridge into a breathing bag and is inhaled again by the used. This apparatus in which inhalation and exhalation takes place in so-called pendulum-type respiration via the chemical and against the resistance thereby produced is intended as self-rescue apparatus or escape-aiding apparatus for a limited usage time of, for example, 20 minutes and single usage, for example, in mines in the event of a sudden contamination of the air. The rescue apparatus consisting of the chemical cartridge with breathing bag and breathing hose has a small overall size and for safety reasons, the user always carries this apparatus with him (passive use), packed in a stable container, for example, by fastening to a belt, when working in a hazardous working environment so that this can be put on immediately and actively used in an emergency. Despite the high mechanical loading usually persisting over many years where active use is unnecessary, for example, in harsh mining operation, the apparatus must nevertheless be continuously ready for use and fully functional in an emergency. However, this conflicts with the fact that the chemical provided in granular form for easy passage of respiratory air undergoes gradual pulverisation as a result of the multiple vibration of the apparatus, possibly over many years. The powder can fall into the breathing bag or become deposited in the area of the bottom of the chemical cartridge and thus in the area of the opening of the breathing bag on a cotton-wool-like material which retains the fine dust particles and as a result of moisture or the heat generated by the exothermic reaction to give oxygen, can result in adhesion to the cotton wool or backing so that unhindered flow of respiratory air and therefore the efficiency of the rescue apparatus is no longer ensured.

Hardening of the granular material which would reduce the abrasion and dust formation has the negative consequence of a reduced reaction capacity and a delayed reaction of the chemical with the carbon dioxide so that in this case too little oxygen is produced.

In order to achieve uniform flow through the chemical accommodated in the canister, it is already known from DE 34 26 757 to form a screen-like, dome-shaped air passage element lined with cotton wool on the chemical side whereby the largest possible air passage area is provided between the chemical and the breathing bag and the dust deposition per unit area is minimised. An acute-angle-shaped screen disposed in front of the opening to the breathing bag is intended to divert the melting granules as a result of the exothermic reaction of the chemical with the carbon dioxide laterally into a collecting ring and thereby ensure the continuous free passage of air between the canister (chemical cartridge) and the breathing bag. The pulverisation of the granules as a result of mechanical loading over many years during passive use and functional inefficiency of the rescue apparatus caused thereby cannot reliably be eliminated by this means.

Furthermore, it has already been proposed that a multiply folded stainless-steel wire mesh extending over the total length in the flow-through direction should be inserted in the chemical cartridge and in addition, an elastic wire mesh should be arranged on the front sides and thereby reduce the vibrations acting on the granules. However, the vibrations cannot be completely avoided by this means since the folded mesh insert is not dimensionally stable and can become displaced in the chemical cartridge. It is difficult or impossible to uniformly fill the cartridge with the granules. Nevertheless and even more so after a preceding mechanical loading, the respiratory physiological performance is significantly restricted. The multilayer wire mesh placed one above the other, which can abut flat against the inner walls of the cartridge, creates an air passage channel which passes completely through the granules so that a large portion of the carbon dioxide contained in the exhaled air does not come in contact with the chemical and thus is not absorbed.

It is the object of the invention to provide an oxygen-generating breathing apparatus in which functional efficiency is preserved without restriction despite persistent external mechanical action.

According to the invention, this object is achieved with an oxygen-generating breathing apparatus whereby a flat impact-damping means consisting of a multilayer fine wire mesh, which adjoins a front cover of the chemical cartridge provided with openings and running transversely to the direction of flow is provided in the external air treatment chambers and a damping element consisting of a multilayer fine-wire mesh which runs in a zigzag fashion and is fixed on one side to a wire grid, having walls aligned in the direction of flow but disposed in an offset manner with respect to one another in the adjacent air treatment chambers is provided in the middle air treatment chambers. For persons working under harsh conditions, even after prolonged external mechanical action persisting over many years, the oxygen-generating breathing apparatus configured according to the invention is capable of functioning immediately without restriction as a self-rescue apparatus in an individual case of necessity and with high respiratory physiological performance.

Advantageous further developments and appropriate embodiments of the invention are the subject matter of the dependent claims.

The oxygen-generating breathing apparatus comprises a chemical cartridge in which oxygen is generated for respiration using the carbon dioxide contained in the exhaled air. Connected to the chemical cartridge is a breathing hose with mouthpiece on one side and a breathing bag as an air reservoir on the opposite side. According to the invention, the chemical cartridge is divided into individual, successive air treatment chambers by means of fixedly arranged retaining grids. Located in the two outer air-treatment chambers is an impact-damping means consisting of a multilayer and therefore elastic fine wire mesh, adjoining the respective front cover of the chemical cartridge whilst the middle air treatment chambers accommodate a damping element likewise consisting of a multilayer fine-wire mesh but folded in a zigzag fashion and aligned perpendicularly on the retaining grids, i.e. in the direction of flow, which is fixed on one of the zigzag edges. However, the zigzag elements provided in the adjacent air treatment chambers are not in alignment but are arranged offset with respect to one another, preferably as a mirror image. The air treatment chambers contain the chemicals for oxygen generation provided substantially in granular form and optionally in one chamber for carbon dioxide binding, close-packed by agitating and pressing. The elastic fine wire meshes of the impact damping means have a very smooth outer surface.

Even after many years of non-active use in which the apparatus and in particular the chemical has been exposed to high mechanical loads (impacts, vibrations), in the event of active usage, the oxygen-generating breathing apparatus according to the present invention is able to provide the oxygen necessary for the respiration of the user immediately and unrestrictedly with high performance. The chemical granules are elastically cushioned in the cartridge in such a manner that despite persistent high mechanical loading, hardly any abrasion takes place, that is, no pulverisation of the granules which conflicts with the functional capability. In addition, the construction of the chemical cartridge according to the invention allows the use of a very coarse-grained, cost-effective chemical and optimal flow through the chemical cartridge with high performance data.

In one embodiment of the invention, preferably four air treatment chambers are provided. In this case, the two outer chambers are significantly smaller than the inner ones. The outer chamber connected to the breathing bag is filled with lithium hydroxide tablets as carbon dioxide binding chemical whereas the outer chambers contain a very coarse-grained potassium hyperoxide granular material for oxygen generation. The small (first) air treatment chamber adjoining the breathing hose also immediately ensures oxygen generation in the below-zero temperature range.

According to another important feature of the invention, the impact damping means provided in the two outer chambers consist of copper and at the same time function as additional heat exchangers for cooling the respiratory air strongly heated in the exothermic reaction for generating oxygen so that respiratory comfort is enhanced.

The damping elements in the middle air treatment chambers are made of a fine-wire mesh made of stainless steel, pre-fabricated as a hose. The hose is compressed and folded once in the longitudinal direction and is provided after a copper wire mesh insert has previously been inserted centrally for stabilisation. After subsequently stapling together, the mesh package is folded in a zigzag fashion and joined to a wire grid at one of the edges running in a zigzag fashion. The fold edges of the mesh packages running substantially parallel to the inner wall are located at a distance from the inner surface of the relevant air treatment chamber in the chemical cartridge.

Figure 2:
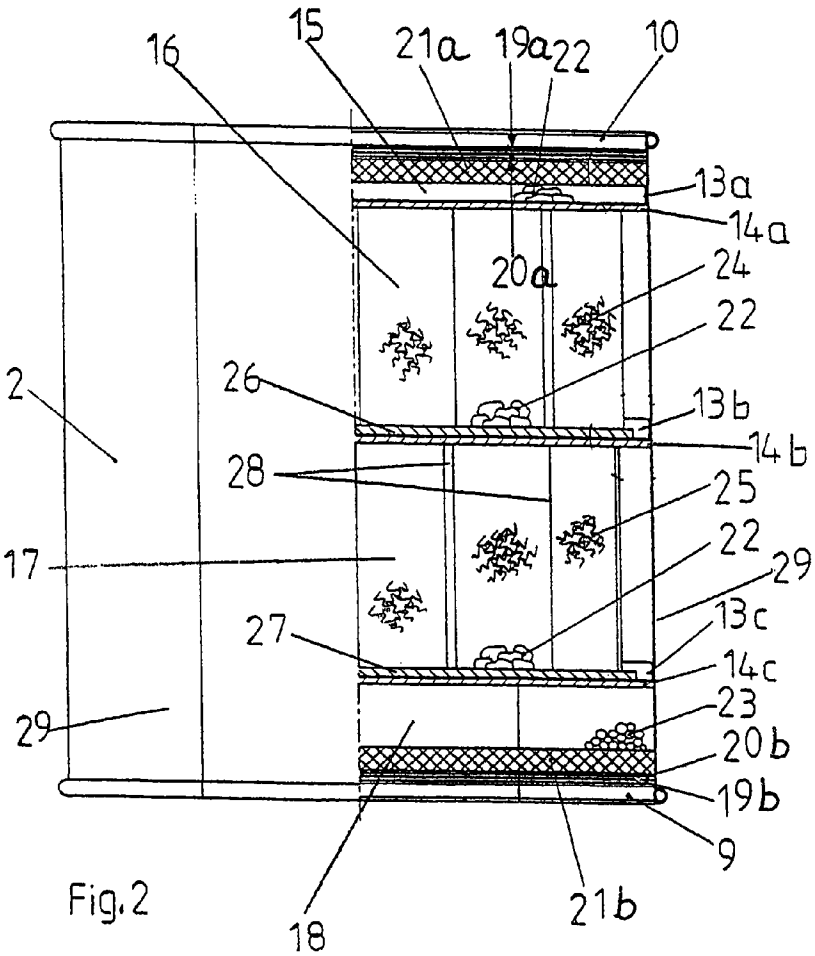

An exemplary embodiment of the invention from which further advantageous embodiments are deduced is explained in detail with reference to the drawings. In the figures:

FIG. 1 is a front view of an unpacked breathing apparatus for oxygen generation with a breathing bag shown in partially cutaway view and a chemical cartridge inserted therein; and FIG. 2 is a front view of chemical cartridge reproduced partially in section.

The breathing apparatus for generating oxygen comprises a breathing bag 1 made of an airtight material 1, a chemical cartridge 2 held sealingly in an opening of the breathing bag 1 and a breathing hose 3 with mouthpiece 4 and nose clip 5. The breathing hose 3 is connected integrally to a receptacle 6 enveloping the upper region of the chemical cartridge 2 whereby the chemical cartridge 2 is held sealingly in the breathing bag 1 by means of a clamp fastening 7. During non-active use the breathing apparatus is packed in a stable sheet-metal container, preferably held on the belt of the user. When the wearer of the breathing apparatus finds himself in an environment with non-breathable gas or smoke, the package container is opened and inhalation and exhalation then takes place via the mouthpiece 4. $CO_2$ contained in the respiratory air reacts with the $KO_2$ granules contained in the chemical cartridge 2 producing heat to give oxygen which passes via openings (not shown) in the lower cover 9 of the chemical cartridge 2 into the breathing bag 1 and from there is inhaled via the chemical cartridge 2, openings (not shown) in the upper cover 10, the breathing hose 3 and the mouthpiece 4. Located on the upper cover 10 is a heat exchanger 12 bordered by a sealing collar 11. The heat exchanger 12 consists of a package of fine copper screens and an air-permeable cover bordered by two coarse-mesh stainless steel screens but which retains extremely fine particles.

In the present embodiment the chemical cartridge 2 is divided into four air treatment chambers 15 to 18 by three retaining screens 14*a* to 14*c* each fixed at a circlip 13*a* to 13*c*. Located in the first (upper) air treatment chamber 15 and in the fourth (lower) air treatment chamber 18, in each case starting from the upper and lower cover 10, 9, is a coarse screen 19*a*, 19*b* made of stainless steel, a fine screen 20*a*, 20*b* made of copper and a multilayer flat elastic fine wire mesh made of copper as upper and lower impact damping means 21*a*, 21*b*. At the respectively adjoining second or third air treatment chambers 16, 17, the first and fourth air treatment chambers 15 and 18 are respectively defined by the aforementioned retaining screen 14*a* and 14*c*. Located in the remaining intermediate space is coarse-grained potassium hyperoxide ($KO_2$) granules 22 in the first (upper) air treatment chamber 15 and lithium hydroxide (LiOH) tablets 23 in the fourth (lower) air treatment chamber 18, that is, the $KO_2$ and the LiOH are mounted elastically with respect to the rigid upper and lower cover 9, 10 to intercept vibrations and impacts and avoid pulverisation. The fine screens 20*a*, 20*b* are provided for safety and retain fine $KO_2$ particles which may be present there in the chemical cartridge 2.

The arrangement of the first relatively flat air treatment chamber 15 ensures the immediate functioning of the breathing apparatus, that is the reaction of the carbon dioxide with the potassium hyperoxide to give oxygen, at very low temperatures, for example 5° C. The lithium hydroxide in the fourth air treatment chamber 18 has the task of binding the $CO_2$ excess produced at high respiration rates. In addition to the damping effect, an important function of the impact damping means 21*a*, 21*b* consisting of copper lies in its effect as an additional heat exchanger so that the comparatively high inhalation temperature as a result of the exothermic reaction can be significantly reduced.

Located in the second and third air treatment chamber 16 and 17 is respectively one flat damping element 24, 25 consisting of a fine wire mesh but folded in a zigzag shape. The damping elements 24, 25 arranged on edge in the direction of flow in the air treatment chambers 16, 17 are fastened to a wire grid 26, 27 at respectively one edge running in a zigzag fashion. The longitudinal edges 28 of the folds, that is the fold edges of the damping elements 24, 25 run at a distance parallel to the side walls 29 of the chemical cartridge 2. The fine wire mesh of the damping elements 24, 25 consists of four layers of stainless steel, formed from a hose laid together and folded once in the longitudinal direction, and a copper wire mesh which lies between the two outer layers thus formed and has a stabilising effect. These five layers are additionally stapled together so that in conjunction with the fixing to the wire grid 26 or 27, compact damping elements 24, 25 are provided, the walls (folds) thereof being inherently and entirely elastic. The intermediate spaces defined by the elastic walls of the respective damping elements 24, 25 are completely filled with the potassium hyperoxide granules 22 by exerting a compacting pressure and shaking. As a result of the elastic fixing of the granules in a plurality of air treatment chambers 15 to 18 separated from one another by means of the retaining screens 14, and having the upper and lower impact damping means 21*a*, 21*b* and the two zigzag-shaped damping elements 24, 25, the chemicals 22, 23 accommodated in the chemical cartridge 2 are elastically fixed with reference to externally acting vibrations and collisions such that the abrasion and dust formation is negligible and the breathing apparatus is capable of functioning immediately during active use in an emergency even after many years of passive use.

Considering the formation of the chambers and the arrangement of two zigzag-shaped damping elements 24, 25, the latter are arranged as a mirror image with respect to one another with reference to the zigzag shape so that their walls on both sides run offset with respect to one another, that is they do not lie in alignment. As a result, particularly uniform flow through the two air treatment chambers 16, 17 filled with potassium hyperoxide granules 22 is achieved so that inexpensive coarse-grained granules can be used and as a result of the optimal through-flow of respiratory air thereby achieved, ultimately very good respiratory physiological performance data are achieved.

REFERENCE LIST

1 Breathing bag
2 Chemical cartridge
3 Breathing hose
4 Mouthpiece
5 Nose clip
6 Elastic receptacle for 2
7 Clamp fastening
8 —
9 Lower cover of 2
10 Upper cover of 2
11 Sealing collar
12 Heat exchanger
13 Circlip
14 Retaining screen
15 First (upper) air treatment chamber
16 Second (middle) air treatment chamber
17 Third (middle) air treatment chamber
18 Fourth (lower) air treatment chamber
19 Coarse screen (stainless steel)
20 Fine screen (copper)
21 Flat impact damping means (copper)
22 Potassium hyperoxide granules
23 Lithium hydroxide tablets
24 Zigzag-shaped damping element
25 Zigzag-shaped damping element
26 Wire grid of 24
27 Wire grid of 25
28 Fold edge (longitudinal edges) of 24, 25
29 Side wall of 2

The invention claimed is:

1. An oxygen-generating breathing apparatus comprising:

a chemical cartridge through which respiratory air for generating the oxygen flows in both directions, which is connected to a breathing hose and a breathing bag, wherein the chemical cartridge comprises a plurality of air treatment chambers separated from one another by air-permeable retaining screens and an air treatment chamber adjacent to the breathing bag is filled with a carbon-dioxide-binding chemical, wherein a chemical for oxygen generation, present as granules, is located in the other air treatment chambers, wherein external air treatment chambers of the plurality of air treatment chambers each include a flat impact-damping member consisting of a multilayer fine wire mesh, which adjoins a cover of the chemical cartridge, and the flat impact-damping members are provided with openings and extend transversely to the direction of flow, wherein middle air treatment chambers of the plurality of air treatment chambers each include a damping element consisting of a multilayer fine-wire mesh which runs in a zigzag fashion and is fixed on one side to a wire grid, the damping elements having walls aligned in the direction of flow but disposed in an offset manner with respect to one another in the middle air treatment chambers, and wherein each of the impact damping elements consists of a fine-wire mesh hose made of stainless steel, which is compressed in the longitudinal direction and folded once to form adjacent mesh layers, and is provided with a centrally inserted fine mesh insert of copper, and the adjacent mesh layers are stapled together.

2. The breathing apparatus according to claim 1, wherein each of the impact damping members consists of copper and is configured to act as a heat exchanger for cooling the respiratory air heated in an exothermic reaction for generating oxygen.

3. The breathing apparatus according to claim 1, wherein a fine screen for retaining fine particles is located between the impact damping member and the cover in each of the external air treatment chambers.

4. The breathing apparatus according to claim 3, wherein the fine screen is made of copper.

5. The breathing apparatus according to claim 1, wherein the damping elements are folded in a zigzag fashion in such a manner that they oppose one another as a mirror image in the middle air treatment chambers.

6. The breathing apparatus according to claim 5, wherein fold edges of the damping elements that are formed by the damping elements being folded in a zigzag fashion run parallel and at a distance from side walls of the chemical cartridge.

7. The breathing apparatus according to claim 1, wherein the chemical cartridge is divided into air treatment chambers with the aid of circlips and the retaining screens fixed to the circlips.

8. The breathing apparatus according to claim 1, wherein the oxygen-generating chemical is potassium hyperoxide which reacts with the carbon dioxide of the respiratory air and the carbon-dioxide-binding chemical is lithium hydroxide.

9. The breathing apparatus according to claim 8, wherein the potassium hyperoxide is a coarse-grained granular material and the lithium hydroxide is present in the form of tablets.

10. The breathing apparatus according to claim 1, wherein the chemical cartridge is sealingly connected to a heat exchanger at an upper cover towards the breathing hose.

11. The breathing apparatus according to claim 1, wherein a total of four air treatment chambers are provided, wherein the upper first air treatment chamber filled with an oxygen-generating chemical and the lower fourth air treatment chamber filled with a carbon-dioxide-binding chemical are each a multiple smaller than the two centrally arranged second and third air treatment chambers filled with an oxygen-generating chemical.

* * * * *

UNITED STATES PATENT AND TRADEMARK OFFICE

CERTIFICATE OF CORRECTION

PATENT NO. : 8,230,854 B2
APPLICATION NO. : 11/795701
DATED : July 31, 2012
INVENTOR(S) : Frank Kruger et al.

It is certified that error appears in the above-identified patent and that said Letters Patent is hereby corrected as shown below:

Face of the Patent, Column 1, Item (30) Foreign Application Priority Data, "Jan. 19, 2006" should read -- Jan. 19, 2005 --

Signed and Sealed this
Twenty-second Day of January, 2013

David J. Kappos

David J. Kappos
*Director of the United States Patent and Trademark Office*